United States Patent [19]

Yamaguchi et al.

[11] Patent Number: 4,700,103

[45] Date of Patent: Oct. 13, 1987

[54] SPARK PLUG AND ITS ELECTRODE CONFIGURATION

[75] Inventors: Takashi Yamaguchi; Shinichi Nakamura; Takafumi Oshima, all of Aichi, Japan

[73] Assignee: NGK Spark Plug Co., Ltd., Aichi, Japan

[21] Appl. No.: 763,224

[22] Filed: Aug. 7, 1985

[30] Foreign Application Priority Data

Aug. 7, 1984 [JP] Japan ..... 59-166275
Aug. 7, 1984 [JP] Japan ..... 59-166276
Jan. 24, 1985 [JP] Japan ..... 60-11180

[51] Int. Cl.[4] ..... H01T 13/34
[52] U.S. Cl. ..... 313/141; 313/142
[58] Field of Search ..... 313/141, 142

[56] References Cited

U.S. PATENT DOCUMENTS 2,239,561 4/1941 Hopps ..... 313/141.1
2,296,033 9/1942 Heller ..... 313/137 X
3,548,239 12/1970 Eaton ..... 313/141 X
3,868,530 2/1975 Eaton et al. ..... 313/141
4,414,483 11/1983 Nishio et al. ..... 313/141 X
4,514,657 4/1985 Igashira et al. ..... 313/141 X

*Primary Examiner*—David K. Moore
*Assistant Examiner*—Sandra L. O'Shea
*Attorney, Agent, or Firm*—Finnegan, Henderson, Farabow, Garrett and Dunner

[57] ABSTRACT

A spark plug in which a noble metal tip welded to the leading end face of a center electrode is in the form of a fine wire while a noble metal tip welded to the leading end face of a ground electrode is in the form of a wire or column; and when each of the noble metal tips is electrically welded to the leading end face of the center or ground electrode, the end of the noble metal tip in contact with the leading end face of the center or ground electrode is enlarged to form a flange. Therefore the strength between the welded joint between the noble metal tip and the center or ground electrode is satisfactorily increased.

8 Claims, 30 Drawing Figures

FIG. 5(a) FIG.(b)
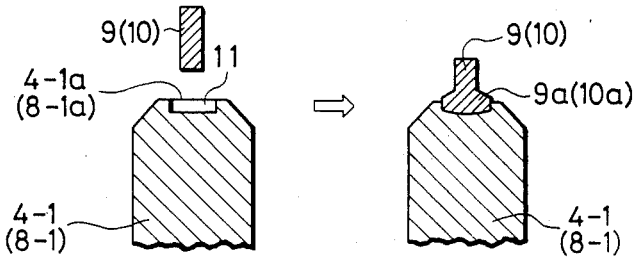
FIG. 6 FIG. 7 FIG. 8
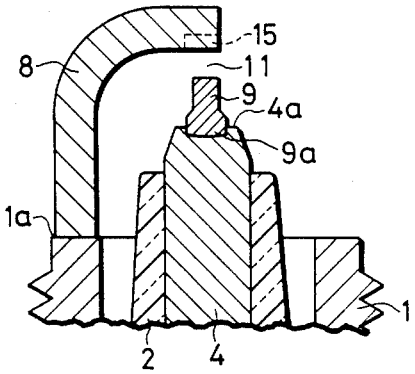
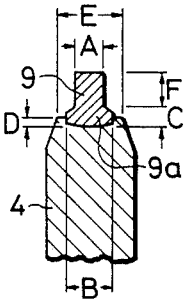
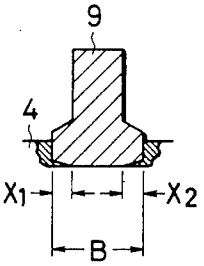

SPARK PLUG AND ITS ELECTRODE CONFIGURATION

BACKGROUND OF THE INVENTION

The present invention relates to a spark plug for an internal combustion engine and more particularly a spark plug of the type in which a spark gap is defined by at least one pair of opposed center and ground electrodes and a fine noble metal tip is welded to the leading end face of at least one of the center and ground electrode main bodies so that energy saving can be attained and long service life can be ensured.

In the spark plugs of the type described above, thin noble metal plates which are made of a platinum alloy such as Pi-Ir,Pt-Rh,Pt-Ni,Pt-Pd or the like and which exhibit high resistance to heat and wear are electrically welded to the spark discharge portions of the center and ground electrodes. A spark plug as described above is diclosed in detail in U.S. Pat. No. 2,296,033.

However, in the spark plugs of the type described, the volume of the center and ground electrodes which define a spark gap is great so that the thermal energy of the flame produced in the spark gap tends to be absorbed by the center and ground electrodes including the thin noble metal plates. As a result, there arises the problem that ignition is adversely affected. Meanwhile, in the recently developed ignition circuits, in order to make an ignition circuit light in weight and less costly to fabricate, both the positive and negative voltages are applied to the spark plug while and negative voltage was applied to the spark plug in the past. The prior art spark plugs have a common defect that the discharge performance is dependent upon the polarity of the voltage applied to the spark plug.

Therefore in order to minimize the flame extinguishing action or effect, when a fine noble metal wire less than 1.0 mm in diameter is electrically welded to the leading end face of an electrode main body, the welded joint between the noble metal tip and the electrode main body is too small in area to provide the required joint strength. Furthermore, the noble metal tip and the electrode main body have different coefficients of thermal expansion so that when the spark plugs are mounted on an engine, the noble metal tips very frequently tend to be separated from the electrode main bodies and drop off in the worse case. In order to overcome the above problems, there has been devised and demonstrated a method in which a noble metal tip is previously formed with an enlarge flange or is fitted into a recess of the electrode main body and thereafter the leading end portion including said recess is caulked and simultaneously the noble metal tip is welded. Such method is disclosed in detail in Japanese Patent Publication No. 56-45264. In either case, the noble metal is used in large quantities and even when the noble metal tips are formed with a flange and electrically welded to the electrode main bodies, separation of the noble metal tips from the electrode main bodies cannot be avoided.

SUMMARY OF THE INVENTION

The present invention was made to overcome the above and other problems encountered in the prior art spark plugs and has for its object to provide a novel spark plug in which the use of an expensive noble metal is reduced to a minimum, the separation of the noble metal tip from the electrode main body is facilitated, and durability and ignition properties are improved.

According to one embodiment of the present invention, when a cylindrical noble metal tip is electrically welded to the leading end face of an electrode main body, the leading end of the noble metal tip is enlarged to form a flange so that the welded joint area is increased and consequently the joint strength is increased, whereby durability is increased and the use of the noble metal is minimized.

According to another embodiment of the present invention, the diameter A of a noble metal tip, the diameter B of a flanged portion formed when the noble metal tip is welded to an electrode main body, the thickness C of the flange and the depth D of the noble metal tip embedded into the electrode main body satisfy the following relations:

$A = 0.5\text{–}1.2$ mm, $B \geqq 0.3$ A mm, $C \geqq 0.25$ mm, and $D \geqq 0.1$ mm.

As described above, according to the second embodiment, the noble metal tip in the form of a cylinder and with the diameter A defined above is used so that the quantity of the noble metal used is minimized and ignition is improved. Furthermore the sizes B,C and D are determined as defined above so that the separation of the noble metal tip is facilitated and durability is improved. In addition, according to the second embodiment, the leading end portion of an electrode main body is in the form of a column or is tapered so that the diameter of the leading end E satisfies the following relation:

$1.5\ A < E < 2.3\ A$.

Furthermore, the height or extension F of the noble metal tip above or beyond the flanged portion satisfies the following relation:

$0.6A < F < 1.3A$

As a result, thermal stresses in the noble metal tip can be reduced and durability can be further improved.

According to a third embodiment of the present invention, the cross sectional area of a noble metal cylinder to be welded to a center electrode is less than 0.8 $mm^2$ and the cross sectional area of a noble metal body welded to a ground electrode is less than 1.3 $mm^2$. The leading end of the noble metal block welded to the ground electrode is extended beyond the leading end of the ground electrode. As a result, the discharge voltage can be lowered and the spark plug which is not influenced by the polarity of a voltage applied thereto can be provided. The noble metal tip welded to the center electrode (A) is extended by 0.4–1.5 mm from the leading end of the center electrode (A) while the noble metal body welded to the ground electrode (B) is extended by 0.4–1.5 mm beyond the leading end of the ground electrode (B). Therefore, the above-described discharge characteristics can be maintained, the resistance to wear can be improved and the noble metal tips or bodies are prevented from being broken.

The above and other objects, effects, features and advantages of the present invention will become more apparent from the following detailed description of the preferred embodiments thereof taken in conjunction with the accompanying drawings.

BRIEF DESCRIPTION OF THE DRAWINGS

FIG. 5 shows another method for joining a noble metal tip to an electrode main body;

FIG. 6 is a partial view, on enlarged scale, of a second embodiment of the present invention;

FIG. 7 shows the joint between a tip and an electrode main body;

FIG. 8 is a view showing corrosion due to oxidation after tests;

DESCRIPTION OF THE PREFERRED EMBODIMENTS

First Embodiment, FIGS. 1–5

Figure 1:
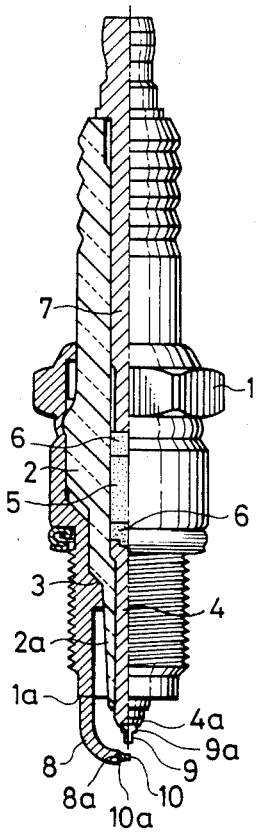
FIG. 1 is a side view, partly in section, of a first embodiment of a spark plug in accordance with the present invention.

FIG. 1 is a side view partly in section of a first embodiment of a spark plug in accordance with the present invention. Reference numeral 1 designates a main metal member adapted for mounting on an engine; 2 an insulator 2 made of high alumina or the like is securely fitted into the main metal member 1 through a packing 3 by a conventional caulking method; a center electrode 4 consisting of a nickel alloy such as Ni-Si-Cr-Al alloy, Ni-Cr alloy or Ni-Cr-Fe alloy or a copper core sealed in such nickel alloy and fitted into an axial hole 2*a* of the insulator 2 in such a way that the leading end of the center electrode is extended beyond the leading end of the insulator, the center electrode being integral with a resistor 5 sandwiched by electrically conductive glass seals 6 and a terminal electrode and being sealed in the insulator 2 by heating; and a ground electrode 8 made of a nickel alloy and extending from a circular end surface 1*a* of the main metal member 1.

According to the present invention, a noble metal tip 9 in the form of a fine wire (cylindrical) is welded to the leading end face 4*a* of the center electrode 4 in such a way that the noble metal tip 9 is engaged on the welded surface so as to define a flange portion 9*a*. A noble metal tip 10 in the form of a fine wire or a column is welded also to the leading end surface 8*a* of the ground electrode 8 in such a way that a flange portion 10*a* is formed. In order to prevent degradation of the discharge characteristics and to minimize the flange extingushing action, it is preferable in practice that the cross sectional area of the tip 9 is less than 0.8 $mm^2$ and that the tip 10 is made of a platinum alloy wuch as Pt-IR,Pt-RH,Pt-Ni or Pt-Pd with the surface area being less than 1.3 $mm^2$. Preferably the tip 10 has a minimum cross sectional area 0.2 $mm^2$ or is about 0.5 mm in diameter.

Figure 2:
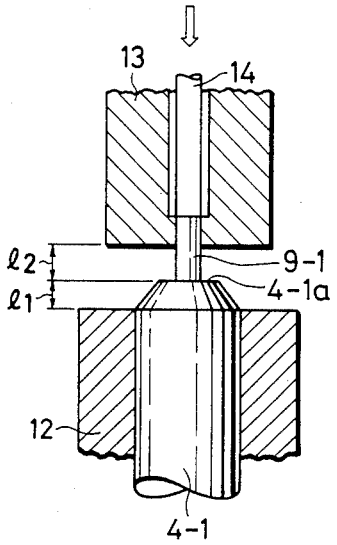
FIGS. 2–4 show the steps of welding a noble metal tip to an electrode main body.
Figure 3:
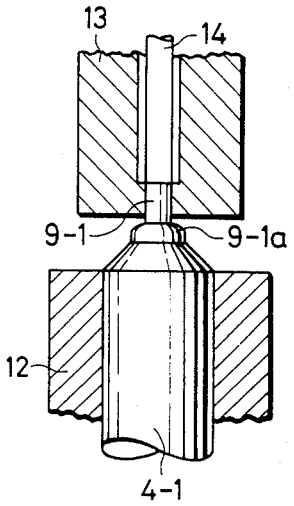
Figure 4:
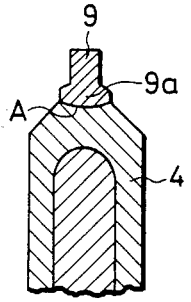

Next the preferably methods for joining the noble metal tips to the center and ground electrodes will be described. FIGS. 2–4 show the noble metal tips joined to the center and ground electrodes. A center electrode main body 4-1 comprises a nickel alloy with a copper core extended axially therethrough. The main body 4-1 is fabricated by a conventional molding method. The leading end of the electrode main body 4-1 terminates into a frustoconical shape 4-1*a*. The frustoconical leading end 4-1*a* is easily formed when the main body 4-1 is fabricated by machining. The electrode main body 4-1 is inserted into a lower chuck 12 of an electric resistance welding machine and securely clamped in such a way that the leading end 4-1*a* is extended beyond the upper surface of the chuck 12 by $1_1$ as shown in FIG. 2. The noble metal tip 9-1 is inserted into an upper chuck 13 and securely clamped in such a way that the leading (lower) end of the noble metal tip 9-1 is extended downward beyond the lower surface of the chuck 13 by $1_2$. A shaft or rod 14 is extended through the upper chuck 13 in such a way that the shaft or rod 14 is moved down in unison with the upper chuck 13, thereby pressing the rear (upper) end of the noble metal tip 9-1. The upper chuck 13 is lowered in such a way that the leading end of the noble metal tip 9-1 is made into contact with the leading (upper) end surface 4-1*a* of the electrode main body 4-1. Under these conditions, electric current passes through the noble metal tip 9-1 and the electrode main body 4-1 so that the noble metal tip 9-1 is heated. As a result, as shown in FIG. 3, the noble metal tip 9-1 is welded (A) to the electrode main body 4-1 forming a flange portion 9-1*a* whose diameter is greater than that of the noble metal tip 9-1. Thus the center electrode 4 as shown in FIG. 4 is provided. The size of the enlarged-diameter flange portion 9-1*a* is dependent upon the above-described lengths $1_1$ and $1_2$ and welding conditions such as voltage, current, welding time, and pressure exerted on the noble metal tip 9-1 and the like.

When the leading end of the center electrode main body 4-1 is 2.6 mm in diameter and made of Inconel® 600 the end surface 4-1*a* is formed into a frustonical shape having a diameter of 1.5 mm. When the noble metal tip 9-1 is 0.8 mm in diameter and 1.4 mm in length and made of Pt-Ir, the flange portion 9-1*a* has a diameter of about 1.4 mm after welding. The center electrode thus fabricated is assembled with the insulator and the main body. In like manner, the noble metal tip 10 is 1.0 mm in width and 1.0 mm in thickness and is welded to the top end surface 8*a* of the ground electrode 8. The ground electrode 8 is 2.7 mm in width and 1.3 mm in thickness and made of Inconel® 600 and extended from the main metal body. Thus the spark plug in which the tips 9 and 10 are spaced apart from each other by a suitable distance to define a spark plug gap is provided. The spark plug thus obtained was subjected to the endurance test for 100 hours with a four cylinder engine running at 5000 rpm. It was confirmed that the noble metal tips were not adversely affected at all and remained firmly welded to their respective electrode main bodies. In the prior art, after the noble metal tip 9-1 has been welded to the electrode main body 4-1, the weldment must be subjected to a heat diffusion treatment so as to form an alloy layer, but according to the present invention, such treatment can be eliminated because the flange portion is formed when the noble metal tip is welded to the electrode main body so that a sufficient welding area can be secured.

Referring next to FIG. 5, an axial recess 11 is formed at the leading end face 4-1*a*(8-1*a*) of the center electrode main body 4-1 (ground electrode main body 8-1) and the noble metal tip 9 (10) is fitted into the recess 11 and is welded to the main body 4-1 (8-1) in such a way that the flange portion 9*a*(10*a*) is partially or completely embedded into the axial recess 11. According to this method, the shape of the flanged portion is stabilized. It is preferable that the noble metal tip is extended beyond the leading end face by 0.4–1.5 mm.

As described above, according to the first embodiment of the present invention, the noble metal tips are welded to the leading end of the electrode main bodies in such a way that the resulting flanges provide a sufficiently large weld area. As a result, even when the noble metal tip to be welded to the center electrode main body is less than 0.8 $mm^2$ in cross sectional area and the noble metal tip to be welded to the ground electrode main body is less than 1.8 $mm^2$ in cross sectional area, the joint between the noble metal tip and the electrode main body is very strong so that excellent durability of the noble tips can be ensured. Thus the spark plug having discharge characteristics and ignition properties considerably improved is provided.

Second Embodiment, FIG. 6

FIG. 6 is a sectional view, on enlarged scale, of a second embodiment of a spark plug in accordance with the present invention. When the noble metal tip 9 in the form of a fine cylindrical wire is welded to the leading end face 4*a* of the center electrode main body 4, the flange portion 9*a* which increases the welded joint is simultaneously formed. In order to prevent the degradation of the discharge characteristics and the flame-extinguishing action, the noble metal tip 9 is 0.5–1.2 mm in diameter and is made of a Pt alloy such as Pt-Ir,Pt-Ni or Pt-Pd. It is preferable to use a Pt-Ir alloy consisting of 70–90% by weight of Pt and 30–10% by weight of Ir or a Pt-Ni alloy consisting of 80–90% by weight of Pt and 20–10% by weight of Ni because it exhibits a high degree of resistance to wear, a high degree of resistance to high temperature and a high degree of tenacity. When the diameter of the noble metal tip is less than 0.5 mm, durability and the joint strength are considerably decreased and when the diamter of the noble metal tip is greater than 1.2 mm, ignition is degraded and the fabrication cost is increased. As indicated by the broken lines, a noble metal member 15 may be welded or otherwise joined to the ground electrode 8 by a conventional method in order to improve the resistance to wear.

The tip 9 is welded to the top end of the center electrode main body 4 in a manner substantially similar to that described above in the first embodiment with reference to FIGS. 1–5 so that, as shown in FIG. 7, the flange portion 9*a* is formed. The inventor found out the fact that in order to attain a satifactory welded joint strength, the diameter B of the flange portion should be equal to or greater than 1.3 A mm; the thickness C is equal to or greater than 0.25 mm and the depth D of the portion of the flange portion embedded in the electrode main body 4 is equal to or greater than 0.1 mm depending upon the diameter of the noble metal tip.

That is, in the experiment, a six-cylinder engine with a displacement of 2000 cc was driven in such a way that the engine was driven at a full throttle at 5000 rpm for one minute and then idled for one minute whereby the spark plugs were subjected to the alternate heating and cooling test for 100 hours (8000 cycles) Thereafter the lengths $X_1$ and $X_2$ (See FIG. 8) of the portions corroded by oxidation were measured. In order to determine the limits of the sizes B,C and D, the chip-separation-danger rate is used.

Figure 9:
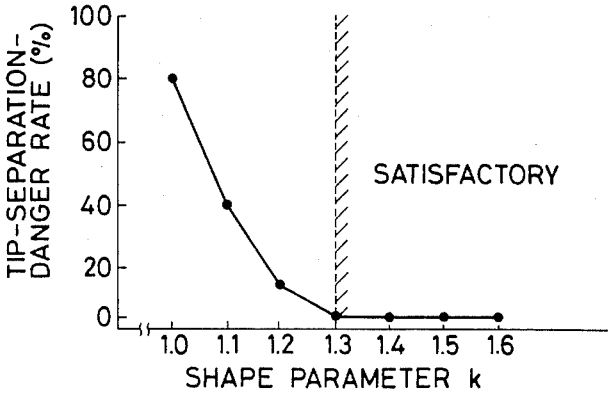
FIGS. 9–11 are graphs showing the relationships between the tip-separation- danger rate on the one hand and the shape parameter, size C and size D on the other hand.
Figure 10:
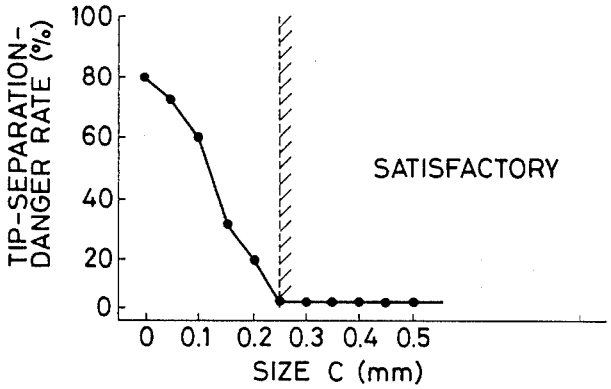
Figure 11:
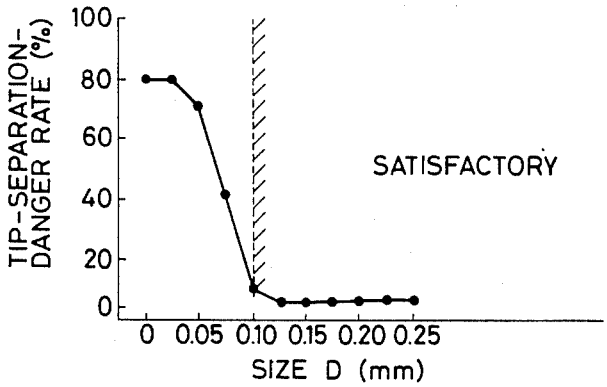

The diameter B of the flange portion formed when the noble metal tip is welded to the electrode main body is given by $k=B/A(k \geqq 1)$, where k is a parameter representative of the shape of the flange portion and, as shown in FIG. 9, it is seen that k must be in excess of 1.3 in order to secure a satisfactory welded joint. As shown in FIG. 10, it is seen that the thickness C of the flange portion must be in excess of 0.25 mm. When the thickness C is less than 0.25 mm, the peripheral portion of the flange is distorted upwardly due to the repeated stress due to alternate heating and cooling so that there arises the problem that the corrosion due to oxidation is accelerated. The depth D of the flange portion embedded into the electrode main body must be in excess of 0.1 mm as shown in FIG. 11 in order to ensure the increase in welded joint strength. If the depth D is less than 0.1 mm, the tip tends to be easily separated from the electrode main body so that the spark plug cannot be used in practice. The above-described sizes of the flange portion are determined by controlling the welding conditions such as welding current, welding time and pressure load and so on.

In the second embodiment of the present invention, the sizes of the noble metal tip and the flange portion of the center electrode are determined in the manner described above. In addition, in order to satisfactorily relieve the thermal stress to further improve durability, the leading end of the electrode main body 4 is so machined that it is tapered or it becomes in the form of a cylinder with the diameter E of the top end satisfying the following relation:

$$1.5A < E < 2.3A$$

Furthermore, the length F of the tip 9 above the flanged portion should satisfy the following relation:

$$0.6A < F < 1.3A$$

If the above-described relations are satisfied, the spark plug exhibits satisfactory durability.

Figure 12:
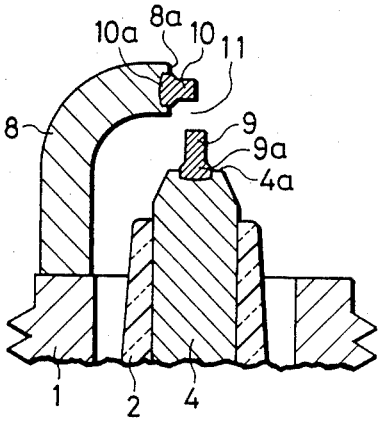
FIGS. 12,13 and 14 are partial sectional views, on enlarged scale, of some modifications of the second embodiment shown in FIG. 6.
Figure 13:
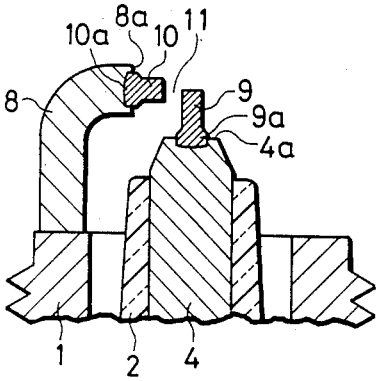
Figure 14:
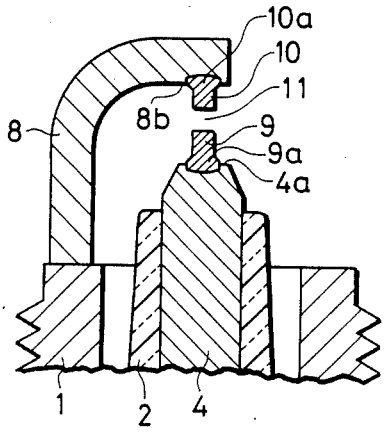

Some modifications of the spark plug in accordance with the present invention are shown in FIGS. 12, 13 and 14. In a first modification shown in FIG. 12, the noble metal tip 9 is electrically welded to the leading end face 4*a* of the center electrode 4 in such a way that the flanged portion 9*a* is formed. In like manner, the noble metal tip 10 is welded to the leading end face 8*a* of the ground electrode 8 in opposed relationship with the leading end of the tip 9 of the center electrode 4 in a manner substantially similar to that described above so that the flanged portion 10*a* is simultaneously formed and furthermore the sizes A,B,C and D satisfy the above-described relations. A spark gap 11 is defined between the leading end of the noble metal tip 9 and the side surface of the noble metal tip 10 of the ground electrode 8.

In a second modification shown in FIG. 13, the spark gap 11 is defined between the leading end face of the tip 10 welded to the leading end face 8*a* of the ground electrode 8 and the side surface of the leading end of the noble metal tip 9 of the center electrode 4. Especially in the case of the second modification, a plurality of ground electrode may be provided so that a plurality of spark gaps may be defined.

In a third modification as shown in FIG. 14, the tip 10 is a welded to the side surface 8*b* at the leading end of the ground electrode 8 in opposed relationship with the leading end of the tip 9 of the center electrode 4 in such a way the flanged portion whose sizes satisfy the above-described relations is formed. Therefore, the spark gap 11 is defined between the leading end of the tip 10 and the leading end of the tip 9 of the center electrode 4.

As described above, according to the second embodiment and its modifications of the present invention, the noble metal tip is welded to the leading end face of at least one of the center and ground electrodes in such a way that the flanged portion is formed. In this case, the diameter A of the noble metal tip, the diameter B of the flanged portion thus formed, the thickness C thereof and the depth D of the flanged portion embedded into the electrode main body satisfy the above-described relations. As a result, even when the noble metal tip is very fine, it can be welded to the electrode main body in such a way that a satisfactorily high welded joint strength can be ensured and therefore the separation of the welded tip from the electrode main body can be prevented in a stable manner. Therefore, durability of the noble metal tip can be ensured. In addition, the discharge characteristics and the ignition properties of the spark plug can be considerably improved. Moreover, since the electric welding can be used, the spark plugs in accordance with the present invention can be mass produced. Furthermore, the amount of tips can be reduced so that the fabrication costs can be considerably lowered.

Figure 15:
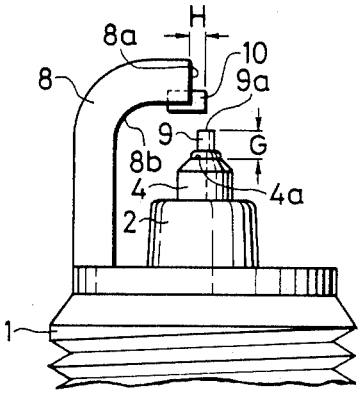
FIG. 15 is a partial front view, on enlarged scale, of a third embodiment of a spark plug in accordance with the present invention.
Figure 16:
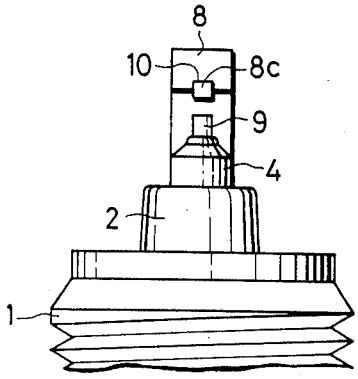
FIG. 16 is a side view of a spark plug illustrated in FIG. 15.

Third embodiment, FIGS. 15 and 16

Referring next to FIGS. 15 and 16, a third embodiment of the present invention will be described. The noble metal body 9 in the form of a cylinder is welded to the leading end face 4*a* of the frustoconical leading end of the center electrode 4. Preferably the noble metal body 9 is made of a platinum alloy such as Pt-Ir,Pt-Rh,Pt-Ni,Pt-Pd and so on and has a cross sectional area of less than 0.8 $mm^2$. The minimum diameter of the noble metal block 9 is about 0.5 mm (0.196 $mm^2$) and the diameter of the noble metal block 9 is in the form of a wire whose diameter is less than about one millimeter (0.785 $mm^2$). The height G of the noble metal body 9 above the leading end face 4a of the center electrode 4 is between 0.4 and 1.5 mm. A square or rectangular noble metal body 10 is welded to the leading end face 8*a* of the ground electrode 8 which is in parallel with the leading end face 9*a* of the noble metal body 9 welded to the center electrode 4. The cross sectional area of the noble metal body 10 is less than 1.3 $mm^2$ and preferably is greater than or equal to the cross sectional area of the center electrode. Therefore even when the spark gap is extended deep into the combustion chamber, the resistance to wear can be ensured. For instance, a recess 8*c* 1.01 mm in width and 0.5 mm in depth is formed at the center of the inner surface 8*b* of the nickel main body 8 which is 2.5 mm in width and 1.7 mm in thickness, and a platinum alloy which is similar to the noble metal body 9 of the center electrode and which is 1.0 mm in width and 1.0 mm in thickness is fitted as the noble metal body 10 into the recess 8*c* and welded. The height H of the noble metal body 10 extended from the leading end face 8*a* of the ground electrode 8 is between 0.4 and 1.5 mm. The noble metal body 10 is welded to the ground electrode 8 in such a way that the lower surface of the noble metal body 10 is coplanar with the inner surface 8*b* of the ground electrode 8 or is slightly extended beyond the inner surface 8*b* (by less than the thickness of the noble metal body 10).

The spark plugs were fabricated according to the third embodiment described above. The Pt-Ir alloy body 1.0 mm in diameter and 1.4 mm in length was welded to the leading end face of the center electrode in such a way that the height G of the noble metal body was 0.7 mm. The noble metal body 1.0 mm in thickness, 1.0 mm in width and 1.4 mm in length and made of a Pt-Ir alloy was welded to the ground electrode in such a way that the extension H of the noble metal body was 0.7 mm. For the sake of comparison, the prior art spark plugs B were used. In the prior art spark plug B, a thin noble metal plate 0.9 mm in diameter and 0.4 mm in thickness was welded to the leading end of the center electrode and a thin noble metal disk 0.2 mm in thickness was welded to the leaing end of the inner surface of the ground electrode which is in opposed relationship with the thin noble metal disk of the center electrode. The spark plugs in accordance with the invention and the prior art spark plugs B were mounted on four cylinder engines with a displacement of 2000 cc and the number of ignition failures were measured for three minutes during idling in terms of the CO concentration in the exhaust gases which is correlated with an air-fuel ratio. The results showed that when the spark plugs in accordance with the present invention were used, the ignition failures were less than when the prior art spark plugs were used. Furthermore, in the cases of pressure spark tests in which the center electrodes had the negative or positive polarity, it was found out that the discharge voltage of the spark plugs A of the present invention was lower than that the prior art spark plugs B especially when the center electrodes had the positive polarity.

Figure 17:
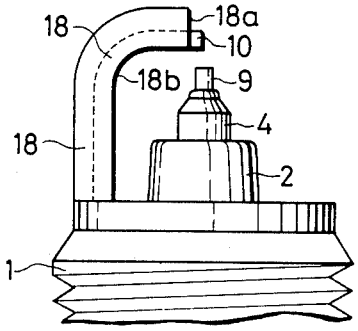
FIGS. 17,18 and 19 show modifcations of the third embodiment shown in FIG. 15.
Figure 18:
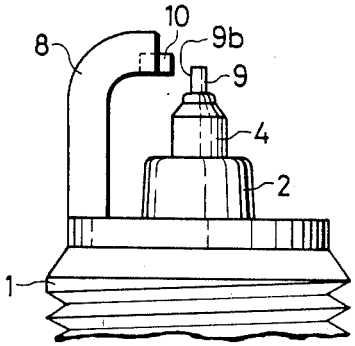
Figure 19:
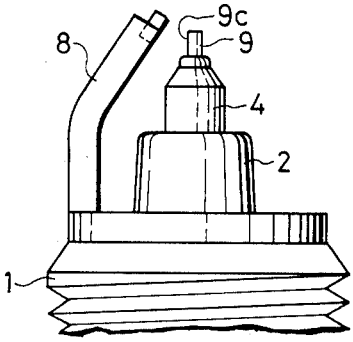
Figure 20A:
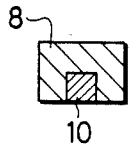
FIG. 20 shows in cross section various joints between noble metal bodies and ground electrode main bodies.
Figure 20B:
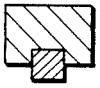
Figure 20C:
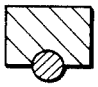
Figure 20D:
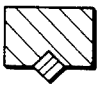
Figure 20E:
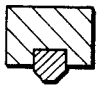
Figure 20F:
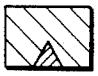
Figure 20G:
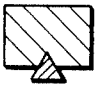

FIGS. 17, 18 and 19 show modifications of the third embodiment of the present invention. A first modification as shown in FIG. 17 is different from the third embodiment in that a longitudinal groove 18*c* is formed in the inner surface 18*b* along the center line thereof the ground electrode main body 18 and the noble metal body 10 is fitted into such groove 18*c* and welded in such a way that the leading end of the noble metal body is extended beyond the leading end of the ground electrode main body 18. Since the groove 18c can be formed when the ground electrode main body 18 is fabricated, the spark plug as shown in FIG. 17 is adapted for mass production.

In a second modification as shown in FIG. 18, the noble metal body 10 of the ground electrode 8 is in opposed relationship with the side surface 9*b* of the noble metal body 9 of the center electrode. In a third modification as shown in FIG. 19, the noble metal body 10 of the ground electrode 8 is disposed in opposed relationship with the edge 9*c* of the leading (upper end of the noble metal body 9 of the center electrode 4. With these constructions, the flame-extinguishing action of the electrodes can be reduced and ignition can be improved. Furthermore there is an advantage in that the noble metal body 10 of the ground electrode may be circular or elliptical in cross section so that the discharge characteristics are not adversely affected.

The reason why the sizes G and H are limited between 0.4–1.5 mm is as follows. That is, when the size G or H is less than 0.4 mm, the flame extinguishing action of the electrodes is decreased so that ignition is not satifactorily improved. On the other hand, when the size G or H is in excess of 1.5 mm, the temperature rises because of a small thermal capacity of the noble metal body so that wear is accelerated. As a result, the noble metal body welded to the electrode main body tends to break off so that the spark plug cannot be used in practice.

FIG. 20 shows various joints between ground electrode main bodies and noble metal bodies in accordance with the present invention. The noble metal body may be square in cross section as shown at (*a*) and (*b*), round in cross section as shown at (*c*), rhomboidal or diamond in cross section as shown at (*d*), trapezoidal in cross section as shown at (*e*) and triangular in cross section as shown at (*f*) and (*g*). At least one portion of the noble metal body is embedded at the leading end of the electrode main body and welded thereto.

Figure 21A:
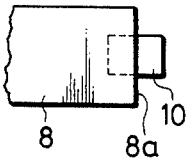
FIG. 21 shows the shapes of the leading ends of ground electrodes.
Figure 21B:
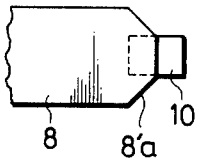
Figure 21C:
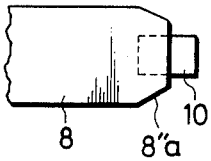

As shown in FIG. 21, the leading end face 8a of the ground electrode main body may be flat (a) or the leading end portion of the ground electrode 8 may be tapered as indicated by 8'*a* or 8''*a* (B) or (C) so that the flame extinguishing effect or action can be considerably decreased.

As described above, according to the third embodiment of the present invention, the cross sectional area of the noble metal body welded to the center or ground electrode is smaller as compared with the prior art spark plugs and the extension of the noble metal body beyond the leading end face of the electrode main body is limited within a predetermined range. As a result, the discharge voltage can be lowered, the flame extinguishing effect or action of the electrodes can be decreased and ignition can be improved. Especially in the case of the ignition power supply using the positive and negative polarities, the third embodiment is very advantageous. In addition, the long serve life can be ensured.

What is claimed is:

1. A spark plug having a center electrode and a ground electrode, each electrode having a noble metal tip, wherein at least one of said noble metal tips comprises a separate noble metal tip portion butt welded to said electrode, said noble metal tip portion having a first end with a diameter less than the electrode to which it is attached and a second end having a flanged portion thereon, said flanged portion being formed by resistance welding said second end of said tip portion to the outer surface of one of said electrodes;

wherein A is the diameter of said first end of said noble metal tip, B is the diameter of said flanged portion, C is the thickness of said flanged portion and D is the depth of an indentation on the outer surface of said electrode receiving said flanged portion wherein A through D conform to the following relations $0.5\ \text{mm} \leqq A \leqq 1.2\ \text{mm}$ $B \geqq 1.2\ A\ \text{mm}$ $C \geqq 0.25\ \text{mm}$ $D \geqq 0.1\ \text{mm}$.

2. The spark plug of claim 1 wherein said separate noble metal tip portion is welded to said center electrode wherein the diameter E of the end of said center electrode satisfies the following relation:

$1.5A < E < 2.3A$; and the length of said noble metal tip portion above said flanged portion F satisifes the following relation:

$0.6A < F < 1.3A$.

3. The spark plug of claim 1 wherein said separate noble metal tip portion is comprised of a noble metal selected from the group consisting of: a Pt-Ir alloy consisting essentially of 70–90% Pt and 30–10% Ir and a Pt-Ni alloy consisting essentially of 80–90% Pt and 20–10% Ni.

4. The spark plug of claim 1 wherein said first end of said noble metal tip portion of said at least one noble metal tip has a cross sectional area less than about 0.8 $mm^2$, and said second end is electrically welded to said center electrode; and said other of said noble metal tip has a first end portion having a cross sectional area less than about 1.8 $mm^2$ and a second end portion electrically welded to said ground electrode to form a flange portion at the connection of said second end and said ground electrode.

5. The spark plug of claim 4 wherein said first end of said noble metal tip portion welded to said center electrode extends between 0.4 and 1.5 mm from said center electrode, and said first end portion of said noble metal tip welded to said ground electrode extends between 0.4 and 1.5 mm from said ground electrode.

6. The spark plug of claim 5 wherein said noble metal tip extending from said center electrode is cylindrical, and said noble metal tip extending from said ground electrode is rectangular in cross section and positioned in opposed relation to the leading end surface of said noble metal tip extending from said center electrode.

7. The spark plug of claim 6 wherein said noble metal tip extending from said ground electrode has a circular cross section.

8. The spark plug of claim 4 wherein said ground electrode has a groove formed on the inner surface thereof and said second end portion of said noble metal tip is welded to said ground electrode in said groove, to form a flange on said second end portion.

* * * * *

UNITED STATES PATENT AND TRADEMARK OFFICE

CERTIFICATE OF CORRECTION

PATENT NO. : 4,700,103

DATED : October 13, 1987

INVENTOR(S) : Takashi YAMAGUCHI, et al.

It is certified that error appears in the above-identified patent and that said Letters Patent is hereby corrected as shown below:

In claim 1, column 10, line 2, change:

"B ≧ 1.2 A mm" to --B ≧ 1.3 A mm--

In claim 2, column 10, line 11, change:

"satisifes" to --satisfies--

Signed and Sealed this

Twenty-second Day of March, 1988

*Attest:*

DONALD J. QUIGG

*Attesting Officer*

*Commissioner of Patents and Trademarks*